US005706593A

United States Patent [19]

Allard et al.

[11] Patent Number: 5,706,593

[45] Date of Patent: Jan. 13, 1998

[54] COMPACT IRONING BOARD SECURABLE TO AN EDGE

[76] Inventors: Alice J. Allard; William C. Allard, both of 3333 26th Ave. E. #1294, Bradenton, Fla. 34208

[21] Appl. No.: 796,243

[22] Filed: Feb. 6, 1997

[51] Int. Cl.[6] ..... D06F 81/06

[52] U.S. Cl. ..... 38/103; 38/137; 108/47

[58] Field of Search ..... 38/103, 104, 137, 38/140, DIG. 1, DIG. 2; 108/46, 42, 44, 48, 47, 90, 108, 110, 174, 121, 127, 134, 135; 248/163.1, 188.5, 188.6, 188.8, 432, 439, 440; 297/163; 211/87, 104; D72/66

[56] References Cited

U.S. PATENT DOCUMENTS

| | | | |
|---|---|---|---|
| D. 204,619 | 5/1966 | Chobanian . | |
| D. 369,889 | 5/1996 | Buckner . | |
| 400,799 | 4/1889 | Sebold . | |
| 825,260 | 7/1906 | Baetz | 108/48 |
| 827,237 | 7/1906 | Hofacker . | |
| 1,793,826 | 2/1931 | Porter . | |
| 2,386,139 | 10/1945 | Rasmussen . | |
| 2,548,437 | 4/1951 | Mantagas . | |
| 2,567,613 | 9/1951 | McNulty . | |
| 2,568,686 | 9/1951 | St. Peter . | |
| 2,853,838 | 1/1952 | Hart | 108/42 X |
| 3,680,235 | 8/1972 | Leemhuis . | |
| 4,056,270 | 11/1977 | Greenfield | 108/44 X |
| 4,565,021 | 1/1986 | Kay et al. . | |
| 4,779,539 | 10/1988 | Stiglich . | |
| 4,799,321 | 1/1989 | Johnson | 38/103 |
| 4,862,811 | 9/1989 | Davis . | |
| 4,899,667 | 2/1990 | Miller et al. . | |
| 4,976,205 | 12/1990 | Miller et al. . | |
| 4,995,681 | 2/1991 | Parnell . | |
| 5,040,468 | 8/1991 | Miller et al. . | |
| 5,329,860 | 7/1994 | Mattesky . | |
| 5,369,898 | 12/1994 | Sorensen . | |
| 5,483,761 | 1/1996 | Simpson . | |

FOREIGN PATENT DOCUMENTS

| | | | |
|---|---|---|---|
| 1202126 | 3/1962 | France | 38/104 |
| 2466217 | 4/1981 | France . | |
| 1378 | 1/1904 | United Kingdom . | |
| 2114607 | 8/1983 | United Kingdom . | |
| 92-17095 | 10/1992 | WIPO . | |

*Primary Examiner*—Ismael Izaguirre
*Attorney, Agent, or Firm*—Richard C. Litman

[57] ABSTRACT

A portable, compact ironing board is adapted for use in tight quarters, such as dorm rooms, motor homes, travel trailers, apartments, etc. A plurality of short legs or pegs extend downwardly from the rear portion of the board, with the rear set being positionally fixed relative to the board and the front set being adjustably affixed to the board to adjust the spacing between the front and rear sets of legs. These rearwardly disposed legs are adjusted to fit closely about a generally horizontal ledge or edge, such as a windowsill, countertop edge, etc. to secure the rear portion of the board. Preferably, the rearwardly disposed sets of legs comprise a fixed rear pair and an adjustable forward pair. The forward portion of the board is supported by a single telescoping leg which is extended to a suitable length and braced in some manner. The upper surface of the board is generally conventional, with a suitable pad and ironing surface installed thereover. The rearwardly disposed sets of legs or pegs are installed completely through the board, to provide a solid and secure installation. A fairing is placed over the ends of the legs or pegs on the upper surface of the board and beneath the cover, to provide a smooth and unbroken surface for ironing. The board stores easily in a space approximately three inches wide, due to the folding nature of the forward leg and the short rearwardly disposed legs or pegs.

11 Claims, 3 Drawing Sheets

COMPACT IRONING BOARD SECURABLE TO AN EDGE

BACKGROUND OF THE INVENTION

1. Field of the Invention

The present invention relates generally to smoothing and ironing processes for laundry and clothing, and more specifically to a compact, portable ironing board which is particularly well adapted for use in close quarters, such as motor homes, small apartments, etc. The board is relatively short in length, and includes rearward short peg-like legs with adjustable spacing for removable placement over the edge of a countertop, a window ledge, or the like. A folding forward support leg is also provided.

2. Description of the Prior Art

Portable ironing boards for use in smoothing and ironing laundry and clothing in the home, have been known for quite some time. Even with the development of so-called "wrinkle free" clothing, some touchup work is often needed, and in any event, certain articles of clothing and fabrics still require ironing to look their best. However, the standard ironing board, which is on the order of a foot or more in width and several feet long to provide a continuous, unbroken surface for ironing, is relatively bulky and difficult to store easily, particularly in small quarters such as apartments, dorm rooms, motor homes, etc.

As a result, various means have been developed in the past for the convenient storage of such ironing boards, generally resulting in a built-in, non-portable board which opens from a wall cabinet, the back of a door, or some other structure. Such built in boards are of course completely unsuited for travel, as they cannot be removed easily from their permanent installations for carriage while on travel or to temporary quarters. The standard ironing board, while portable, is unsuited for use in tight quarters, as there is often insufficient space to set up such a standard board in travel trailers, motor homes, dorm rooms, small apartments, etc. Accordingly, various compact and portable ironing boards have been developed in the past, as the need for such is well recognized.

Some of these small and portable boards have been constructed for placement upon a table or desk, resulting in some difficulty in positioning the ironing work around the board as it cannot hang freely from the board, and the awkwardness resulting from having to reach generally horizontally across the relatively wider surface of the table or desk while maneuvering the relatively heavy iron. Other relatively small and compact free standing boards have been developed for a standing person, but these boards have full length legs which produce much the same difficulty of storage as that of a full size board.

Accordingly, a need will be seen for a compact ironing board which may be extended from an existing ledge or similar structure, to provide a height similar to that of a conventional ironing board for convenient use. The legs of the board provide compact storage due to the short, peg-like structure of at least some of the legs which are adapted to secure over a countertop edge or the like, with a single longer leg which telescopes for adjustment and compact storage. A discussion of the prior art publications of which the inventors are aware, and their differences and distinctions from the present invention, is provided below.

U.S. Pat. No. 400,799 issued on Apr. 2, 1889 to John M. Sebold describes an Ironing Board having a rearwardly disposed clamp for securing the board to a relatively thin shelf or the like. The clamp operates to secure the shelf between the rear edge of the board and the clamp jaw. The present board includes a plurality of short, rearwardly disposed legs, with the space between the legs being adjustable and serving to secure the rear of the board to each side of a substantially vertical ledge or the like, rather than to a substantially horizontal shelf, as in the Sebold board. Moreover, the forward leg of the Sebold board is not adjustable in length, thus requiring substantially the same amount of room for storage as a standard size conventional board.

U.S. Pat. No. 827,237 issued on Jul. 31, 1906 to Fred Hofacker describes an Ironing Board having a clamp adapted for securing to a generally horizontal shelf or projecting ledge, somewhat in the manner of the Sebold ironing board discussed immediately above. The same distinctions apply here, with the non-adjustable front leg and other points similar to the Sebold board. Moreover, the Hofacker board clamp structure extends partially over the rear portion of the board, rendering it unusable.

U.S. Pat. No. 1,793,826 issued on Feb. 24, 1931 to Enos Porter describes a Collapsible Ironing Board having a generally vertical rear support with a slot therein providing for the suspension of the board from a conventional doorknob. A diagonal brace is provided from the rear support to the forward portion of the board, but no adjustment of the length of the brace is disclosed. The Porter board cannot be placed over a relatively narrow structural edge for support, as provided by the present board.

U.S. Pat. No. 2,386,139 issued on Oct. 2, 1945 to Viggo Rasmussen describes an Ironing Board having a lateral strap across the upper surface of the rear of the board, for hanging the rear of the board from a doorknob or the like. Such a strap means is unsuitable for securing the rear of the board to a relatively narrow, vertically standing ledge or countertop edge, as provided by the rear support means of the present board. A depending rear leg and diagonal brace serve to brace the board generally horizontally, but neither of the legs is adjustable in length as in the longer forward leg of the present board. Again, the support structure overlying the rear of the Rasmussen board precludes use of the rear of the board, whereas the entire present board is useable.

U.S. Pat. No. 2,548,437 issued on Apr. 10, 1951 to John Mantagas describes a Cabinet With Disappearing Ironing Board. The board is permanently installed in the cabinet and pivots outwardly therefrom, and is not portable as in the present board.

U.S. Pat. No. 2,567,613 issued on Sep. 11, 1951 to Charles G. McNulty describes a Portable Ironing Board having a strap over the rear end of the board for hanging from a doorknob, as in the Rasmussen board discussed further above. McNulty provides a pair of depending braces for an underlying diagonal brace from the forward portion of the board, but the brace is not adjustable in length as with the forward leg of the present board. Moreover, the same problem exists in the McNulty board as in others with overlying support means, in that the portion of the board having the attached overlying support means cannot be used.

U.S. Pat. No. 2,568,686 issued on Sep. 18, 1951 to Gayton F. St.Peter describes a Chair Back Supported Folding Ironing Board having a hook arrangement beneath the rear portion of the board for placement along the upper edge of a chair back. The spacing between the depending hook portions is not adjustable, as is the spacing between the short rear legs of the present board, and while the angle of the diagonal support brace may be adjusted, no adjustment of its length is provided.

U.S. Pat. No. 3,680,235 issued on Aug. 1, 1972 to Rudolph E. Leemhuis describes a Legless Ironing Board having a pair of rearwardly extending hooks for securing over the shafts of doorknobs extending to each side of an open door. The rear of the board also has a notch which mates with the door edge, and a depending triangular brace which extends downwardly along the door edge. No means is provided to secure the rear end of the board over a narrow ledge or the like, and the underlying brace is not adjustable.

U.S. Pat. No. 4,565,021 issued on Jan. 21, 1986 to John W. Kay et al. describes a Portable Ironing Board for tabletop or desktop use, having a plurality of very short folding legs. Only two of the legs are disposed near the rearward end of the board and the spacing is not adjustable between the legs, as in the present board.

U.S. Pat. No. 4,779,539 issued on Oct. 25, 1988 to Nicholas M. Stiglich describes a Wall-Mountable Folding Table which is permanently secured to a wall or other vertical structure by a support frame from which the table foldably extends. The diagonal support leg also folds, but is not adjustable for length, as in the present invention. The Stiglich board cannot be easily removed from its permanent mounting nor installed on a narrow horizontal ledge or the like, as in the present ironing board.

U.S. Pat. No. 4,862,811 issued on Sep. 5, 1989 to Charles J. Davis describes a Swiveling, Wall-Mounted Ironing Board which is contained for storage in a dedicated, permanently installed cabinet within a wall. No means is provided for removal of the board for temporary mounting on a ledge, narrow countertop, or similar structure, as provided by the present board.

U.S. Pat. No. 4,899,667 issued on Feb. 13, 1990 to Benson L. Miller et al. describes a Door Mounted Ironing Board Assembly adapted to hang from the upper edge of a door. The board folds down from a frame which is suspended from the upper edge of the door. No means is provided for securing the board temporarily to a narrow ledge, as in the present board.

U.S. Pat. No. 4,976,205 issued on Dec. 11, 1990 to Benson L. Miller et al. describes a Door Mounted Ironing Board Assembly similar to that described in the '667 patent to the same inventors and discussed immediately above. The same differences as noted between the '667 patent and the present invention also apply here.

U.S. Pat. No. 4,995,681 issued on Feb. 26, 1991 to Clyde B. Parnell describes a Built-In Ironing Board similar to the device described in the '811 patent to Davis discussed further above. The Parnell board extends from a cabinet which is permanently mounted within the wall of a structure, and is not at all portable as provided by the present board.

U.S. Pat. No. 5,040,468 issued on Aug. 20, 1991 to Benson L. Miller et al. describes a Door Mounted Ironing Board Assembly similar to that described in the '667 and '205 patents to the same inventors described further above. The same distinctions noted in the discussions of those two patents also apply here.

U.S. Pat. No. 5,329,860 issued on Jul. 19, 1994 to Henry Mattesky describes a Door Mounted Ironing Board generally similar to the devices of the '667, '205, and '468 patents to Miller et al. described further above. A frame is secured to a door, with the ironing board being foldably extendible from the frame. No means is provided to mount the board temporarily over a relatively narrow ledge or sink rim and countertop, as provided by the present ironing board.

U.S. Pat. No. 5,369,898 issued on Dec. 6, 1994 to Jake A. Sorensen describes a Surface Mount Frame With Nesting Ironing Board, with the frame being permanently mounted to another structure or forming an integral part of the structure (door, etc.). The board pivots downwardly from the opening in the frame, in a manner similar to that of various other prior art devices. The Sorensen board cannot be removed from the frame nor can it be installed on a ledge or the like, as with the present invention.

U.S. Pat. No. 5,483,761 issued on Jan. 16, 1996 to Danny Simpson describes a Door Mounted Ironing Board Assembly With Retractable Holders, similar to the devices of the '667, '205, and '468 patents to Miller et al. described further above. Accordingly, similar distinctions are noted between the Simpson board and the present invention.

U.S. Pat. No. D-204,619 issued on May 3, 1966 to Albert Chobanian illustrates a design for an Ironing Board having a pair of lugs extending rearwardly from the underside of the rear of the board. No means is apparent to secure the board to a sink or countertop lip, ledge or the like as provided by the present board.

U.S. Pat. No. D-369,889 issued on May 14, 1996 to William J. Buckner describes a design for a Travel Ironing Board having a plurality of short legs and a handle extending from one side. The board more closely resembles the tabletop board of the '021 utility patent to Kay, discussed further above, than the present board. No means is apparent in the Buckner design to support the board along a ledge, countertop lip, etc., as provided by the present board.

British Patent Publication No. 1378 published on Jan. 19, 1904 to Evans illustrates a wall table which is permanently secured to a wall or other permanent structure. The table is hinged to the wall at its rearward end, with a diagonal support leg being provided from a point further forward beneath the table to brace in the corner between the underlying floor and the wall to which the table is attached. This leg brace means is similar to that used in the present board, but Evans does not provide means for adjusting the length of the leg itself, as provided in the present invention, but only for adjusting its attachment to the underside of the table.

British Patent Publication No. 2,114,607 published on Aug. 24, 1983 to Sico, Inc. describes an Adjustable Folding Ironing Board which extends from a cabinet which is permanently mounted within a wall structure, similarly to the '811 U.S. patent to Davis discussed further above. Substantially the same distinctions are noted here between the '607 British Patent and the present invention.

French Patent Publication No. 2,466,217 published on Apr. 30, 1981 to Jean Legay illustrates an ironing board which pivots downwardly and outwardly from a permanently mounted wall cabinet frame. A forward support leg is shown in one view, but the leg is apparently not connected to the board, as no folding means is apparent. The Legay board is not portable, and cannot be secured to a narrow ledge or edge as provided by the present ironing board.

Finally, World Patent Publication No. 92/17095 published on Oct. 15, 1992 to Henry Mattesky describes a Door Mounted Ironing Board. This publication is based upon the ironing board disclosed in U.S. Pat. No. 5,329,860 to the same inventor, and discussed further above. Accordingly, the same differences and distinctions are noted between the device of the '095 World Patent and the present ironing board.

None of the above inventions and patents, either singly or in combination, is seen to describe the instant invention as claimed.

SUMMARY OF THE INVENTION

The present invention is a compact, portable ironing board which is adapted for use in tight quarters, such as dorm rooms, motor homes, trailer homes, apartments, etc. The board includes a plurality of short legs or pegs extending downwardly from its rearward portion, with the pegs serving to straddle a ledge, sink lip, countertop edge, or similar relatively narrow horizontal structure. The short legs comprise a forward and a rearward set, with the forward set providing for adjustable spacing between the forward and the rearward set for different ledge or edge widths. A telescoping forward leg is also provided for additional bracing. The board is erected by adjusting the spacing of the forward set of short legs to capture the ledge or edge closely between the forward and rearward legs, and adjusting the telescoping leg to provide further support for the front of the board. The board is easily stored when not in use, due to its compact dimensions.

Accordingly, it is a principal object of the invention to provide an improved compact ironing board which is adapted for removable placement on and securing to a relatively narrow ledge, edge, or similar structure by means of a plurality of rearwardly disposed short legs or pegs extending downwardly therefrom.

It is another object of the invention to provide an improved compact ironing board which rearwardly disposed legs or pegs comprise an adjustably positionable forward set and a fixed rearward set, with the forward set providing adjustable spacing between the forward set and the rearward set to secure to ledges, edges and the like of different widths.

It is a further object of the invention to provide an improved compact ironing board including a relatively long telescoping forward support leg, providing adjustable support for the forward end of the board.

It is an additional object of the invention to provide an improved compact ironing board which rearwardly disposed legs or pegs are fastened securely through the board, with the upper surface of the board including fairing means beneath the padding to provide a smooth surface over the upper ends of the legs or pegs.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
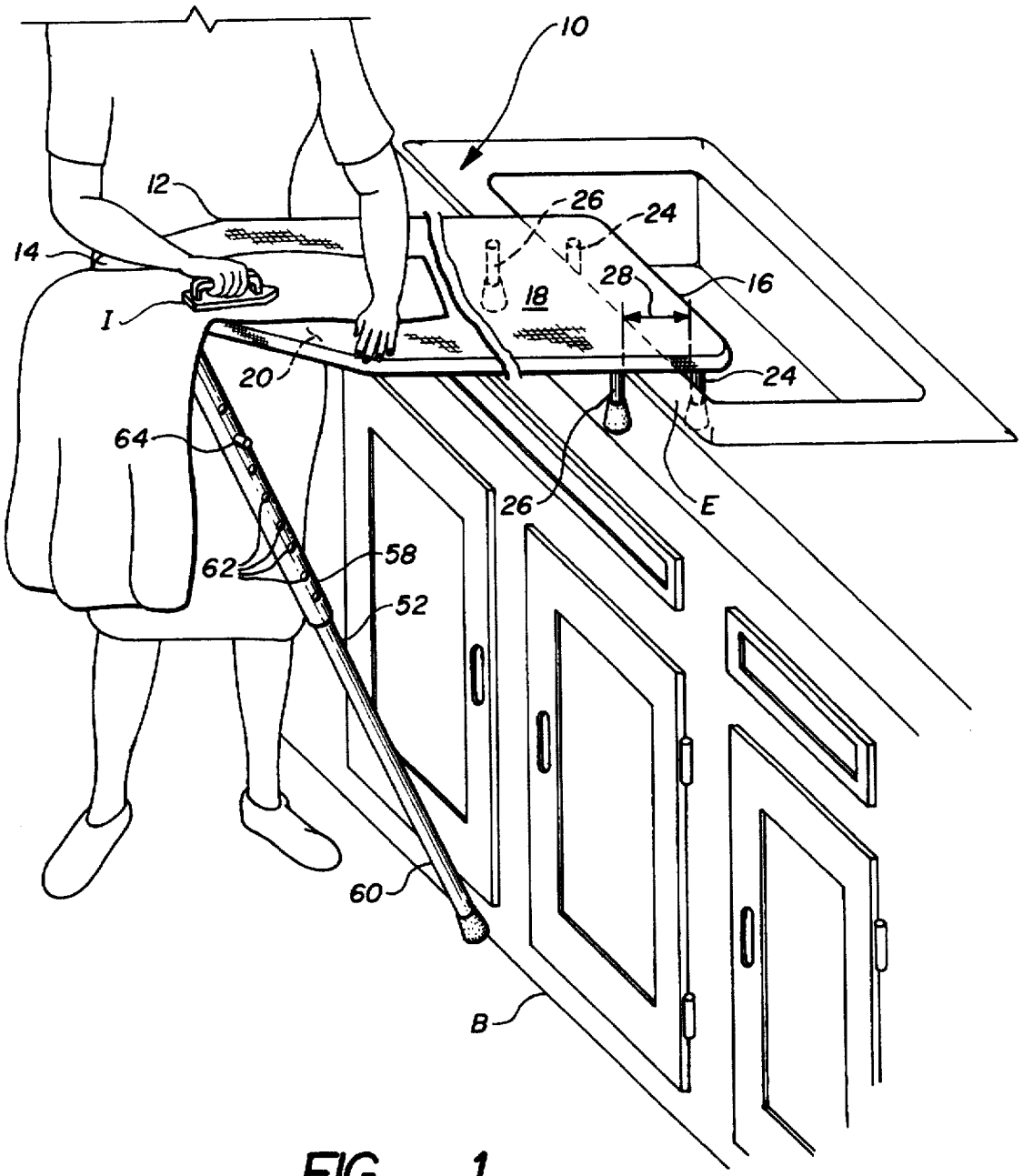
FIG. 1 is an environmental perspective view of the present compact ironing board in use, showing its general features and removable attachment to a ledge or edge.

The present invention comprises a compact, portable ironing board 10, shown in use in FIG. 1. The present ironing board 10 is particularly well adapted for use in relatively tight quarters, as it may be set up to be supported at least partially by a relatively narrow, generally horizontal ledge area, such as the countertop edge E along the front of a sink as shown in FIG. 1, with the remaining support being provided by a supplemental support leg. Thus no complex multiple folding leg mechanism is required, yet the board 10 is conveniently and securely positioned at a comfortable working height.

Figure 2:
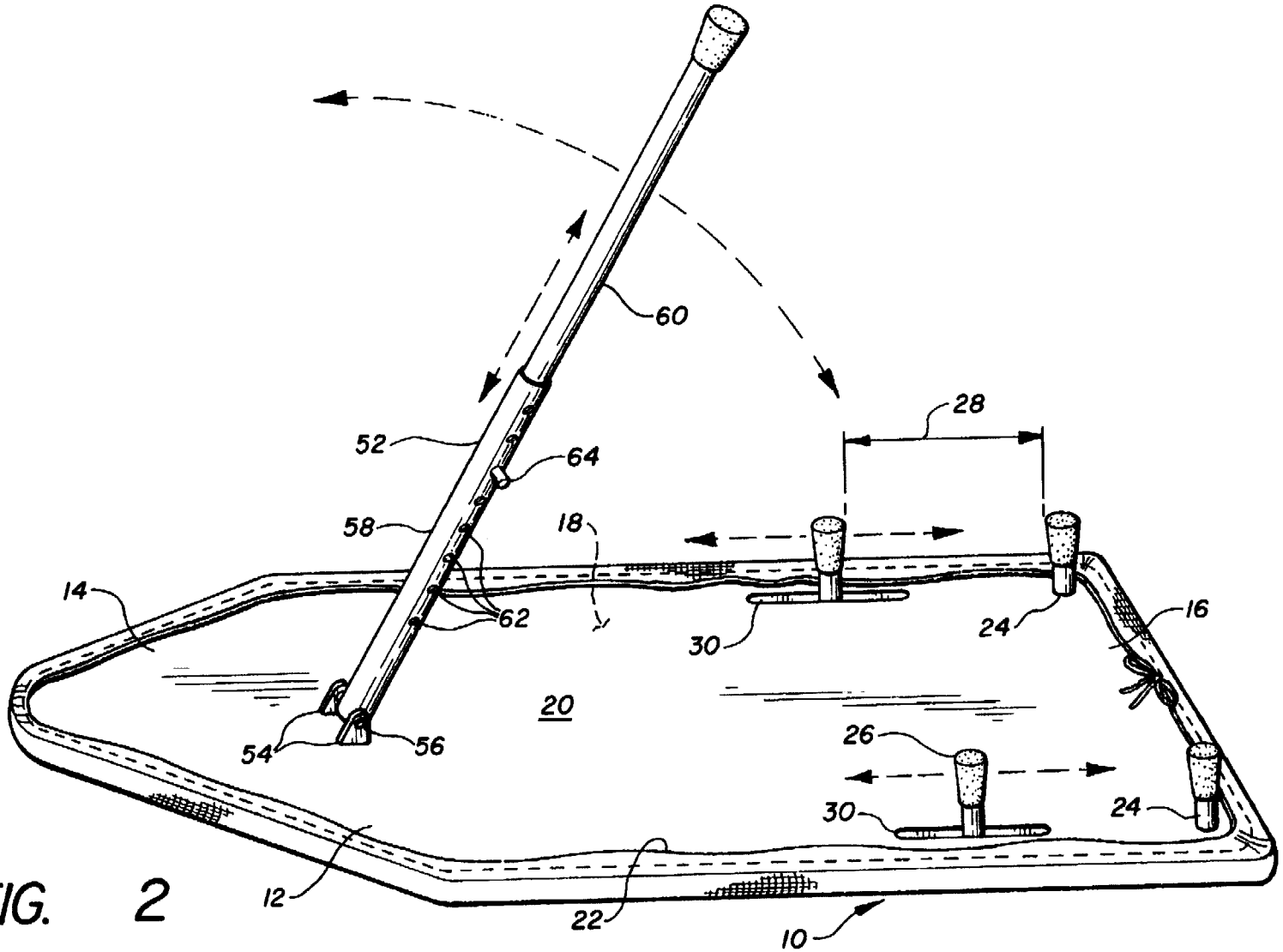
FIG. 2 is a bottom perspective view of the board, showing details of the forward leg and rearward legs or pegs.

The board 10 includes a flat, thin, planar board portion 12 having a forward end 14, an opposite rearward end 16, an upper or top surface 18, and an opposite lower or bottom surface 20 (FIG. 2). The board portion 12 may be formed of any of a number of suitable materials, such as wood, sheet metal, or even a durable plastic material which is resistant to high temperatures, if desired. (The present ironing board 10 is preferably used with arm ironing board cover and/or pad 22, the periphery of which is shown in FIG. 2 beneath the edge of the board portion 12. The use of a cover, and particularly a pad and cover, will alleviate the effects of heat distributed by the iron I to the board portion 12.) The thickness of the board portion 12 is only on the order of one half inch or so (this dimension may be adjusted as desired), thus allowing the board 10 to be stored in a relatively small and narrow area having a width of three inches or less.

The edge securing means for the present compact ironing board 10 comprises a plurality of short (on the order of two inches or so in length, or as desired) legs or pegs which extend downwardly from the bottom surface 20 of the board portion 12 and substantially normally thereto, adjacent the rearward end 16 thereof. These pegs comprise a rearward set of fixed pegs 24, and a forward set of adjustable pegs 26, with each set preferably comprising two laterally spaced apart pegs. (One or more pegs may be provided as desired for each set, and/or the rearward set may be made adjustable in addition to or instead of the front set, if so desired.)

The above described rearward pegs 24 and forward pegs 26 define an edge straddling span 28 therebetween, with the span 28 being adjustable according to the width of the edge E to be straddled by the pegs 24 and 26 by adjusting the position of the adjustable forward pegs 26 relative to the rear pegs 24. The forward pegs 26 each slide back and forth in a respective longitudinal slot 30, which extends completely through the board portion 12. The positions of the adjustable pegs 26 may be locked as desired to secure the rearward end 16 of the board 10 removably to the countertop edge E (or other relatively narrow edge or ledge, such as a windowsill, narrow shelf, etc.), with the adjustment and locking means described below.

Figure 3:
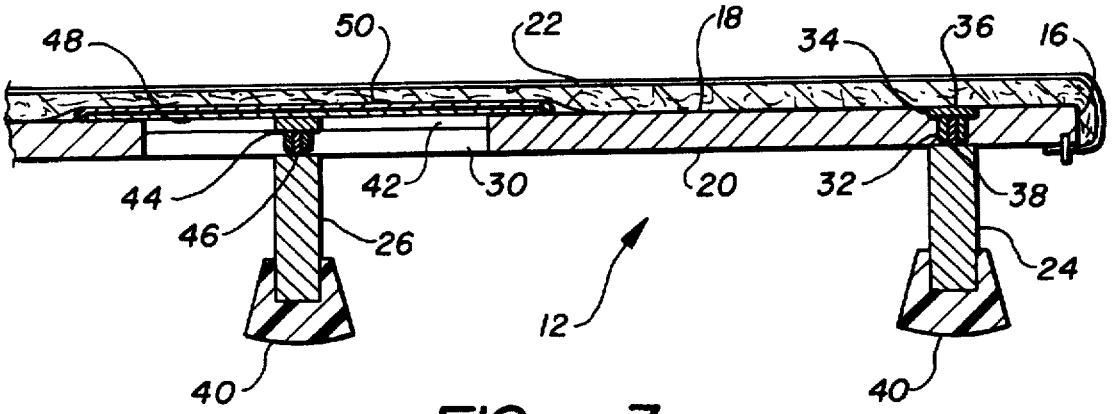
FIG. 3 is a side elevation view in section of the rearward portion of the board, showing the attachment and adjustment details of the rearwardly disposed legs or pegs.

FIG. 3 provides a detail view of the installation of the rearward pegs 24 and forward pegs 26 through the board portion 12, and other details. Each rearwardly disposed fixed peg 24 is secured through the board portion 12 by means of a passage 32 therethrough, with a spotface 34 or the like being formed in the upper surface 18 of the board portion 12. A closely fitting blind nut 36 is inserted into this passage 32, with the relatively wide upper portion of the blind nut 36 being flush with the upper surface 18 of the board portion 12. Each rearward peg 24 includes a mating threaded stud 38 extending therefrom, with the stud 38 being threaded into the blind nut 36 from the bottom side 20 of the board portion 12 to affix the rear peg 24 to the board portion 12. Padded tips 40 may be added to the distal ends of the pegs 24 (and/or to the ends of the movable pegs 26) as desired.

The adjustable pegs 26 are secured through the board portion 12 by means of longitudinally disposed slots 30 located forwardly of each of the respective fixed rear pegs 24. Each of the slots 30 includes a relatively wider upper groove or channel 42 formed in the upper surface 18 of the board portion 12, to capture the wider upper portion of a T-nut 44 therein. (Any barbs or other locking means on the T-nut 44 are removed to allow the T-nut 44 to slide longitudinally within the slot 30 and upper groove 42.) The forward pegs 26 each have a stud 46 extending therefrom, in the manner of the rearward pegs 24, with the forward peg studs 46 engaging a respective T-nut 44 from the underside 20 of the board portion 12 through the slot 30.

As the forward pegs 26 are threaded into the T-nuts 44, adjustment is easily accomplished by partially unscrewing the pegs 26 from their respective T-nuts 44 to loosen the assembly and sliding the peg 26 and T-nut 44 assembly forwardly or rearwardly as desired. The peg 26 is then tightened into the T-nut 44 to lock the base of the peg 26 against the underside 20 of the board portion 12 adjacent the slot 30, to lock the assembly in the desired location within the slot 30.

While the blind nut 36 affixing the rearward pegs 24 to the board portion 12 essentially fill the hole 32 and spotface 34 formed in the board portion 12 therefor, the elongate slot 30 and upper groove 42 for the adjustable pegs 26 provides an opportunity for any board cover and/or padding 22 to be depressed into the slot 30 and groove 42 to each side of the T-nut 44 installed therein. This would result in some interference in the sliding of the T-nut 44 within the slot 30 when adjustment is made of the forward pegs 26, unless some means is used to smooth the operation.

Accordingly, some form of fairing means is preferably provided on the top surface 18 of the board portion 12, at least over the peg adjustment slots 30 and upper grooves 42. The fairing means may comprise a thin sheet or layer of plastic or metal 48 (Nylon/tm or Teflon/tm plastic, steel, aluminum, or brass shim stock or the like, etc.) disposed over each of the slots 30 and channels 42, to provide a smooth undersurface against which the top flange of the T-nut may bear. The sheet fairing 48 may be secured in place by tape 50 or other suitable means as desired, with the fairing 48 and tape 50 being covered by the ironing board cover and pad 22 as shown in FIG. 3. (The thicknesses of the fairing 48 and tape 50 may be exaggerated for clarity in the drawing figure.)

The opposite, forward end 14 of the present ironing board 10 is supported by a single, long, folding support leg 52, shown generally in FIG. 1 of the drawings. The support leg 52 is pivotally secured to the bottom surface of the board portion 12 adjacent the forward end 14 thereof, by a spaced apart pair of attachment ears or lugs 54 having a pivot pin 56 extending mutually through the lugs 54 and the attachment end 58 of the leg 52, as shown in FIG. 2. The lateral pivot axis of the pin 56 allows the leg 52 to fold or pivot rearwardly longitudinally with respect to the board 10 to lie flat against the bottom surface 20 of the board portion 12, while precluding movement in any other direction.

Preferably, the forward support leg 52 is provided with some adjustment means for the length thereof. FIGS. 1 and 2 show a telescoping leg 52, having a first or upper tube 58 (when the ironing board 10 is in a normal, upright position for use) and a concentric second or lower tube 60. The first tube 58 includes a plurality of lateral adjustment holes or passages 62 therethrough, while the second tube includes a lateral leg adjustment locking pin 64 therethrough which is selectively installable through any of the plurality of lateral adjustment holes 62 of the first tube 58 to lock the relative length of the leg assembly 52 as desired. The pin 64 may be spring loaded within the second tube 60, to engage one of the passages 62 of the first tube 58 automatically as the second tube 60 is extended or retracted therein. Alternatively, the pin 64 may be completely removable and may be manually inserted and removed from the tube assembly 58 and 60 as desired.

Figure 4:
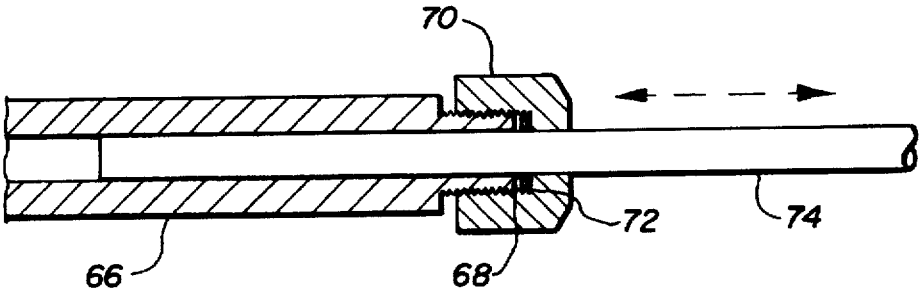
FIG. 4 is a side elevation view in section of the telescoping forward leg, showing an alternative adjustment and locking means.

Alternatively, a different form of leg length adjustment locking means may be used, as shown in FIG. 4. Here, a first tube 66 has a distal end 68 with a threaded collar 70 adjustably installed thereon. A resilient ring 72 is installed between the collar 70 and the threaded distal end 68 of the first tube 68. When the collar 70 is tightened, the resilient ring 72 is compressed against a concentric second tube 74 within the first tube 66, to bear against the second tube 74 and frictionally lock the second tube 74 in place relative to the first tube 66. Other means may be used (split sections crimped against the second tube by the collar, etc.) as desired.

The present ironing board 10 is easily stored within a very small and narrow storage area, on the order of three inches or so wide, even with the rearwardly disposed pegs 24 and 26 remaining affixed to the board 10. As the board portion 12 material is only on the order of one half inch thick and the edge securing pegs 24 and 26 are only on the order of two inches long, it will be seen that even with a cover and/or pad 22 installed on the board portion 12, that the maximum thickness of the present compact ironing board 10 will be no more than three inches or so with the telescoping forward leg 52 collapsed and folded rearwardly toward the rearward end 16 of the board portion 12 to lie against the underside 20 of the board portion 12. This is no more than the typical thickness of a conventional full size ironing board, with its complex multiple folding leg mechanism and overlapping folded legs.

When the present ironing board 10 is needed, it may be removed from its storage area and the forward leg 52 pivoted downwardly below the board portion 12 and extended as necessary to place the board portion 12 substantially horizontally, with the rearward end 20 of the board portion 12 resting upon a convenient ledge or edge, such as the countertop and sink edge E shown in FIG. 1. The fixed rearward pegs 24 are positioned to contact one side of the edge E, with the adjustable forward pegs 26 being loosened, adjusted, and locked in place to capture the ledge or edge securely between the fixed and adjustable pegs 24 and 26. The lower end of the long forward support leg 52 is braced against any convenient structure, such as the cabinet baseboard B of FIG. 1, etc.

The security provided by the grip of the rearwardly disposed pegs 24 and 26, gripping a ledge or edge E therebetween, ensures that the ironing board 10 will not move or swing laterally to any appreciable degree. The long forward leg is laterally rigid and is free to pivot only forwardly and rearwardly, thus providing additional lateral rigidity to the board 10 while simultaneously supporting the front portion of the board.

When the ironing has been completed and the board is not needed, the compact size and particularly the lack of a complex and bulky multiple folding leg mechanism provide for ease of storage in virtually any convenient niche or corner, as the board with its forward leg folded is no more than three inches thick, as noted above. The board 10 is easily readied for storage, by lifting the rearward portion of the board from the ledge or edge straddled by the pegs 24 and 26, and collapsing the long forward leg 52 to its shortest length and folding it rearwardly against the underside of the board portion 12.

Accordingly, the present compact and portable ironing board 10 provides a much needed accessory for travelers and others living in relatively tight quarters. The versatility of the board enables it to be set up virtually anywhere, such as on the edges of washroom basins, shelves, etc., and the elegant board support means provides a very lightweight and economical yet sturdy construction.

It is to be understood that the present invention is not limited to the sole embodiments described above, but encompasses any and all embodiments within the scope of the following claims.

We claim:

1. A compact ironing board removably securable to a generally horizontal narrow edge, comprising:

a flat, thin, planar board portion having a forward end, a rearward end, a top surface, and a bottom surface;

a plurality of short pegs extending downwardly from said bottom surface of said board portion adjacent said rearward end thereof for removably securing said rearward end of said board over the edge;

said short pegs comprising a rearward set and a forward set defining an edge straddling span therebetween, with at least one said set being longitudinally adjustable for adjusting said span between said rearward set and said forward set to fit closely and removably about the edge, and;

a single long folding support leg extending from said bottom surface of said board portion and adjacent said forward end thereof.

2. The compact ironing board according to claim 1, including a total of four said pegs, with said rearward set of pegs and said forward set of pegs each comprising two laterally spaced apart pegs.

3. The compact ironing board according to claim 1, wherein each said pegs is disposed substantially normal to said board portion.

4. The compact ironing board according to claim 1, wherein each of said rearward set of pegs is immovably affixed to said board portion by a threaded fastener extending through said board portion.

5. The compact ironing board according to claim 1, wherein each of said forward set of pegs is individually adjustable, with said board including an adjustment slot extending completely therethrough for each of said pegs of said forward set of pegs and with each of said pegs of said forward set of pegs being adjustably disposed within a respective one of said slots by a threaded fastener extending through said respective one of said slots.

6. The compact ironing board according to claim 5, including fairing means disposed over said top surface of said board portion at least over said slots.

7. The compact ironing board according to claim 1, wherein said forward support leg is pivotally secured to said bottom surface of said board portion to fold against said bottom of said board portion from said forward end of said board toward said rearward end of said board portion.

8. The compact ironing board according to claim 1, including telescoping length adjustment means for said forward support leg.

9. The compact ironing board according to claim 8, wherein said telescoping length adjustment means comprises a first tube including a plurality of lateral adjustment holes therethrough and a concentric second tube including a lateral pin therethrough, with said lateral pin of said second tube selectively engaging one of said lateral adjustment holes of said first tube to lock said first tube and said second tube immovably together as desired.

10. The compact ironing board according to claim 8, wherein said telescoping length adjustment means comprises an outer first tube and a concentric inner second tube, with said first tube having a distal end with a selectively adjustable locking collar thereon for selectively locking said first tube and said second tube immovably together as desired.

11. The compact ironing board according to claim 1, wherein said board portion is formed of material selected from the group consisting of wood, metal, and high temperature plastic.

* * * * *